US008836586B2

(12) United States Patent
Lu

(10) Patent No.: US 8,836,586 B2
(45) Date of Patent: Sep. 16, 2014

(54) ANTENNA SPRING STRUCTURE AND ELECTRONIC DEVICE USING THE SAME

(75) Inventor: Ding Lu, Shanghai (CN)

(73) Assignees: Inventec Appliances (Shanghai) Co., Shanghai (CN); Inventec Appliances Corp., New Taipei (TW)

( * ) Notice: Subject to any disclaimer, the term of this patent is extended or adjusted under 35 U.S.C. 154(b) by 447 days.

(21) Appl. No.: 13/399,383

(22) Filed: Feb. 17, 2012

(65) Prior Publication Data

US 2013/0009827 A1 Jan. 10, 2013

(30) Foreign Application Priority Data

Jul. 4, 2011 (CN) ..... 2011 1 0185272

(51) Int. Cl.
*H01Q 1/24* (2006.01)
*H01Q 1/08* (2006.01)

(52) U.S. Cl.
CPC ..... *H01Q 1/084* (2013.01); *H01Q 1/242* (2013.01)
USPC ..... 343/702; 343/872

(58) Field of Classification Search
USPC ..... 343/702, 872
See application file for complete search history.

(56) References Cited

U.S. PATENT DOCUMENTS 8,564,486 B2 * 10/2013 Wang et al. ..... 343/702
2012/0034957 A1 * 2/2012 Kim et al. ..... 455/572

* cited by examiner

*Primary Examiner* — Dieu H Duong
(74) *Attorney, Agent, or Firm* — Wang Law Firm, Inc.; Li K. Wang; Stephen Hsu

(57) ABSTRACT

An antenna spring structure and an electronic device using the same. The antenna spring structure includes an antenna spring provided with an elastic arm and a protruding portion coupled to the elastic arm, a casing having at least one opening and pivotally coupled to an end of the casing; a cover disposed on the antenna spring and having a first positioning groove and a second positioning groove formed on the protruding portion and disposed with an interval apart, a circuit board disposed inside the casing, and at least one conductive component installed on the circuit board and corresponding to at least one opening, and passed through the at least one opening and exposed from the casing. When the antenna spring is switched from a first position to a second position, the at least one conductive component presses the antenna spring.

16 Claims, 6 Drawing Sheets

ANTENNA SPRING STRUCTURE AND ELECTRONIC DEVICE USING THE SAME

CROSS-REFERENCE TO RELATED APPLICATION

This application claims the benefit of priority to China Patent Application No. 201110185272.X, filed on Jul. 4, 2011, in the State Intellectual Property Office of the People's Republic of China, the disclosure of which is incorporated herein in its entirety by reference.

BACKGROUND OF THE INVENTION

1. Field of the Invention

The present invention relates to an antenna spring structure, in particular to the antenna spring structure applied in an electronic device and an electronic device using the same for transmitting and receiving radio signals.

2. Description of the Related Art

As wireless communication technology advances, various electronic devices with a wireless communication function such as mobile phones, smart phones, notebooks, computers, personal digital assistants (PDA), the global positioning system (GPS) and e-book readers are introduced. It not only makes our life convenient, but also provides a huge quantity of information quickly and improves the interaction between people and the way of exchanging information. Since the wireless communication is not limited by space and communications can take place even in a mobile condition, the wireless communication technology is used extensively in our daily life. Since the wireless communication technology blooms, related manufacturers spare no effort to develop various wireless communication electronic devices to meet the current requirements of the market.

Wireless communication electronic devices usually come with an antenna for transmitting or receiving signals. The general structure of most antenna springs generally used in a wireless communication electronic device is a fixed structure which acts merely as an antenna for receiving signals. In addition, battery covers of some flip electronic devices with wireless communication have a switch structure for connecting the battery cover with a casing. If the aforementioned two structures are combined and applied to the wireless communication electronic device, the antenna structure and the switch structure respectively require specific space for installation, which occupy much design space of the wireless communication electronic device. Due to the tendency toward smaller size of wireless communication electronic devices, the aforementioned issue is a major obstacle. In addition, some wireless communication electronic devices have battery covers detachable from the casing may bring about missing or losing the battery cover. Consequentially, users have to purchase a new battery cover, which incurs an additional cost, and causes trouble to the users. As to the environment, it may waste unnecessary resources.

In view of the foregoing drawbacks of the prior art, the inventor of the present invention designed an antenna spring structure, so that the antenna structure combined with a switch structure can overcome the drawbacks of the prior art.

SUMMARY OF THE INVENTION

In view of the aforementioned problem, it is a primary objective of the present invention to overcome the deficiency of the prior art that causes troubles to users and wastes of environmental resources by providing an antenna spring structure and an electronic device using the same.

To achieve the foregoing objective, the present invention provides an antenna spring structure applied in an electronic device. The antenna spring structure comprises an antenna spring, a casing, a cover, a circuit board and at least one conductive component. The antenna spring is provided with an elastic arm which has a protruding portion. The casing has at least one opening, and the casing is pivotally coupled to an end of the antenna spring. The cover is disposed on the antenna spring and provided with a first positioning groove and a second positioning groove by an interval corresponding to the protruding portion. The circuit board is disposed inside the casing. The at least one conductive component is disposed on the circuit board and passes through the at least one opening to be exposed from the casing. The antenna spring is selectively situated at a first position or a second position. When the antenna spring is situated at the first position, the protruding portion is wedged into the first positioning groove. When the antenna spring is situated at the second position, the at least one conductive component presses the antenna spring.

Wherein, the antenna spring further comprises at least one shaft hole, and the casing further comprises at least one wedged hole. The antenna spring structure further comprises a pivot component passing through the at least one shaft hole and wedged into the at least one wedged hole.

Wherein, the cover includes at least one slide slot sheathed on the antenna spring.

Wherein, the cover includes at least one latch portion, and the casing includes at least one wedged opening corresponding to the at least one latch portion. When the antenna spring is situated at the second position and the protruding portion is wedged into the second positioning groove, the at least one latch portion is wedged into the at least one wedged opening.

Wherein, the circuit board further includes an antenna transmission module electrically coupled to at least one conductive component.

Wherein, the antenna spring is formed by bending a metal or an alloy plate, and the at least one conductive component is made of a metal or an alloy.

To achieve the foregoing objective, the present invention provides an antenna spring structure applied in an electronic device. The antenna spring structure comprises an antenna spring, a casing, a cover and a circuit board. The antenna spring is provided with at least one pivoting portion, at least one conductive portion and an elastic arm, and the elastic arm is coupled to a protruding portion. The casing is provided with at least one opening and at least one wedged hole. The at least one opening is formed correspondingly to the conductive portion, and the at least one wedged hole and the at least one pivoting portion are pivotally coupled. The cover is disposed on the antenna spring and provided with a first positioning groove and a second positioning groove disposed correspondingly to the protruding portion at regular intervals. The circuit board is disposed inside the casing and provided with an antenna transmission module corresponding to the at least one conductive portion. When the antenna spring is situated at a first position, the protruding portion is wedged into the first positioning groove. When the antenna spring is situated at a second position, the conductive portion presses the antenna transmission module.

Wherein, the cover includes at least one slide slot sheathed on the antenna spring.

Wherein, the cover includes at least one latch portion, and the casing includes at least one wedged opening corresponding to the at least one latch portion. When the antenna spring is situated at the second position and the protruding portion is wedged in the second positioning groove, the at least one latch portion is wedged in the at least one wedged opening.

Wherein, the antenna transmission module is electrically coupled to the at least one conductive portion, and the antenna spring is formed by bending a metal or an alloy plate.

To achieve the foregoing objective, the present invention provides an electronic device comprising a casing, a circuit board and an antenna spring structure. The casing has at least one opening. The circuit board is disposed inside the casing. The antenna spring structure comprises an antenna spring, a cover, and at least one conductive component.

The antenna spring is provided with an elastic arm which has a protruding portion. The casing is pivotally coupled to an end of the antenna spring. The cover is disposed on the antenna spring and provided with a first positioning groove and a second positioning groove by an interval corresponding to the protruding portion. The at least one conductive component is disposed on the circuit board and passes through the at least one opening to be exposed from the casing. The antenna spring is selectively situated at a first position or a second position. When the antenna spring is situated at the first position, the protruding portion is wedged into the first positioning groove. When the antenna spring is situated at the second position, the at least one conductive component presses the antenna spring.

Wherein, the antenna spring further comprises at least one shaft hole, and the casing further comprises at least one wedged hole. The antenna spring structure further comprises a pivot component passing through the at least one shaft hole and wedged into the at least one wedged hole.

Wherein, the cover includes at least one slide slot sheathed on the antenna spring.

Wherein, the cover includes at least one latch portion, and the casing includes at least one wedged opening corresponding to the at least one latch portion. When the antenna spring is situated at the second position and the protruding portion is wedged into the second positioning groove, the at least one latch portion is wedged into the at least one wedged opening.

Wherein, the circuit board further includes an antenna transmission module electrically coupled to at least one conductive component.

Wherein, the antenna spring is formed by bending a metal or alloy plate, and the at least one conductive component is made of a metal or an alloy.

In summation, the antenna spring structure and the electronic device using the same of the present invention have one or more of the following advantages:

(1) The antenna spring structure and the electronic device using the same of the invention can be integrated with the conventional antenna structure and switch structure to save the design space of the wireless communication electronic device, so as to miniaturize the wireless communication electronic device.

(2) The antenna spring structure and the electronic device using the same can be combined with the antenna structure and switch structure to produce an integral structure to save material cost, manufacturing and labor cost.

(3) The antenna spring structure and the electronic device using the same can overcome the issue that the cover tends to be missing by installing the cover to the antenna spring, and pivotally coupling the antenna spring to the casing.

DETAILED DESCRIPTION OF THE PREFERRED EMBODIMENTS

The technical characteristics of the present invention will become clear with the detailed description of the preferred embodiments accompanied with the illustration of related drawings as follows. It is noteworthy to point out that same numerals are used for representing respective elements for the description of the preferred embodiments and the illustration of the drawings.

In a preferred embodiment, the wireless communication electronic device may be a mobile phone, a smart phone, a notebook, a computer, a panel PC, a device with global positioning system (GPS), an e-book reader, a personal digital assistant (PDA) or any wireless communication electronic device which an antenna spring structure is disposed therein. To make it easy to understand the technical characteristics of the present invention, the mobile phone is used in the preferred embodiment for illustrating the invention, but the invention is not limited to mobile phones only.

Figure 1:
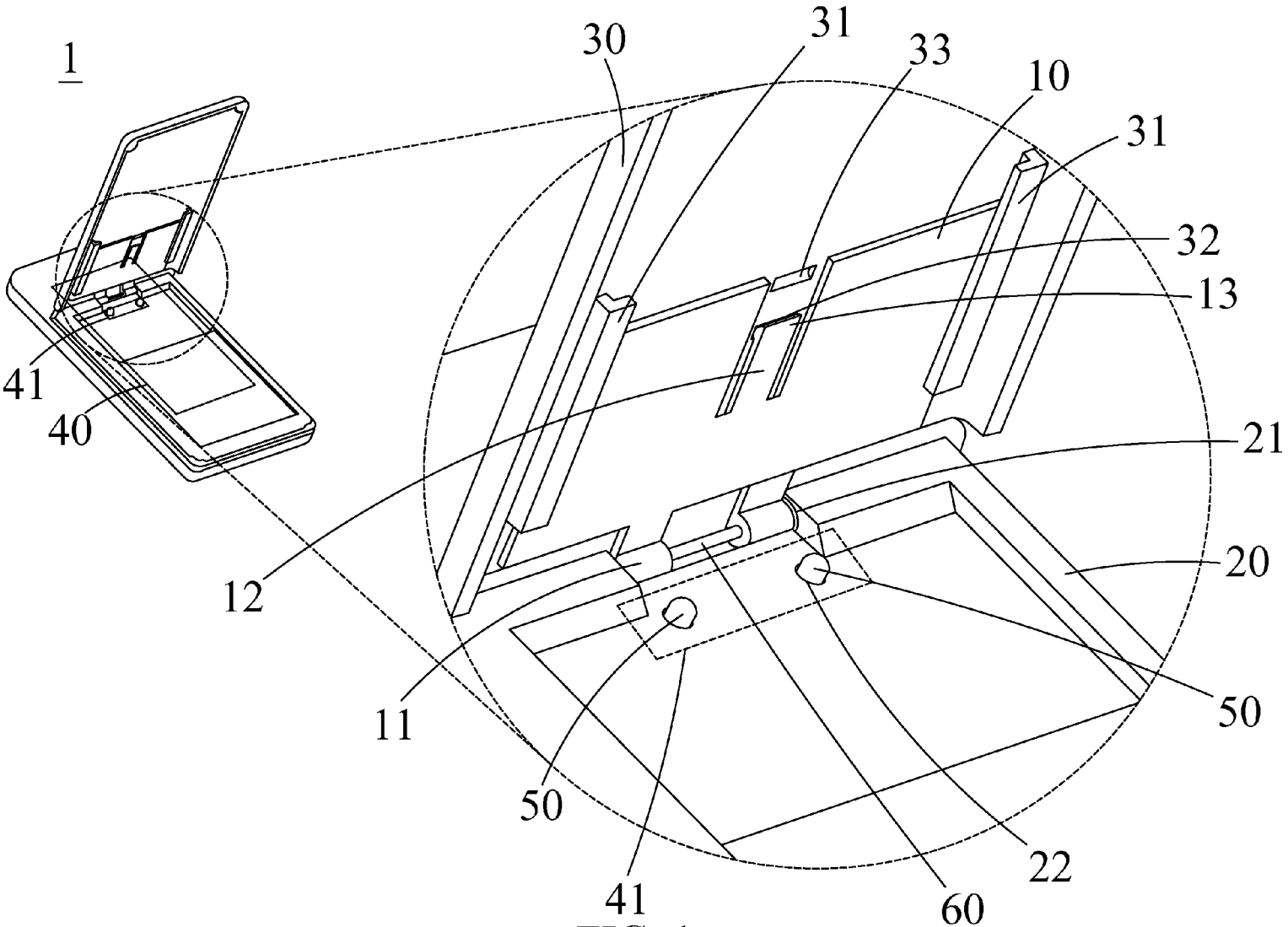
FIG. 1 is a perspective view of an antenna spring structure when a cover is opened in accordance with a first preferred embodiment of the present invention.

With reference to FIG. 1 for a schematic view of an antenna spring structure when a cover is opened in accordance with a first preferred embodiment of the present invention. The antenna spring structure is applied in a wireless communication electronic device 1 and comprises an antenna spring 10, a casing 20, a cover 30, a circuit board 40 and two conductive components 50. Wherein, the antenna spring 10 is substantially rectangular and made by bending a metal or an alloy plate and has two shaft holes 11 form, at regular intervals, at the bottom of the antenna spring 10. An elastic arm 12 is formed by evacuating two areas having an appropriate interval apart and situated at the middle of the antenna spring 10. A protruding portion 13 is coupled to the elastic arm 12 towards the top. In this preferred embodiment, the shape of the antenna spring 10 or the position of the elastic arm 12 is provided for illustrating the present invention, but not intended for limiting the scope of the invention, and they can be changed according to the actual design requirements. Besides, in this preferred embodiment, the antenna spring structure has two conductive components for illustrating the present invention, but not intended for limiting the scope of the invention. In other words, in the other embodiments, the antenna spring structure may have one, three or more than three conductive components.

The casing 20 comprises two wedged holes 21. A pivot component 60 passes through the two shaft holes 11 of the antenna spring 10, and both sides of the pivot component 60 are wedged into the two wedged holes 21 of the casing 20 respectively. The pivot component 60 may be a rod or a hinge.

The pivot component 60 being a rod is used as an example of the pivot component 60 in this preferred embodiment for illustrating the present invention, but it can be changed according to the actual design requirements. For example, the hinge is installed in the shaft hole 11 of the antenna spring 10, and another side of the hinge is wedged into the wedged hole 21 of the casing 20 such that the cover can be lifted automatically. Thus, the present invention is not limited to the aforementioned arrangement only.

The cover 30 includes two L-shaped slide slots 31 disposed on both sides of the antenna spring 10 respectively. The cover 30 includes a first positioning groove 32 and a second positioning groove 33 disposed with an interval apart from each other and corresponding to the protruding portion 13. The protruding portion 13 can be wedged into the first positioning groove 32 or the second positioning groove 33, so that the cover 30 can be slid reciprocally between the two positions of the antenna spring 10.

The circuit board 40 is disposed inside the casing 20, and the two conductive components 50 corresponding to the two openings 22 of the casing 20 are disposed on the circuit board 40 and pass through the openings 22 to be exposed from the casing 20. The circuit board 40 includes an antenna transmission module 41 electrically coupled to the two conductive components 50 for transmitting and receiving signals. Wherein, each conductive component 50 can be a conductive column, spring or elastic plate. The conductive column is used as an example in this preferred embodiment for illustrating the present invention, but the conductive component 50 can be changed according to the actual requirements. For example, a conductive spring can be used instead, such that the contraction and extension properties of the spring can be used to overcome the assembling tolerance to avoid poor compression of the conductive component 50 and the antenna spring 10 in order to improve the yield rate.

When the cover 30 is opened, the protruding portion 13 of the antenna spring 10 is wedged into the first positioning groove 32 of the cover 30. The arrangement of installing the cover 30 to the antenna spring 10 and pivotally coupling the antenna spring 10 to the casing 20 can prevent the cover 30 from missing.

Figure 2:
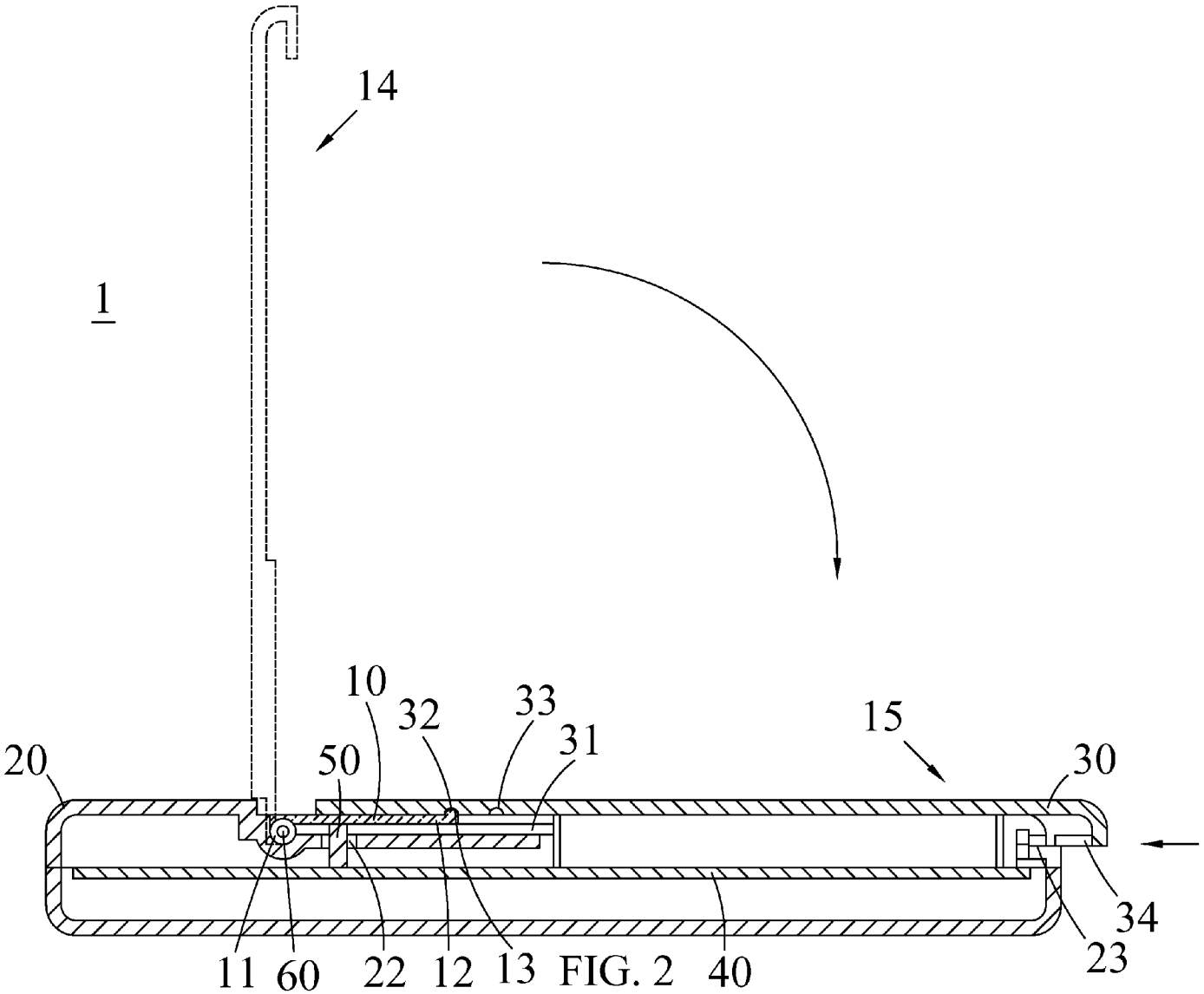
FIG. 2 is a cross-sectional view of a first operation of an antenna spring structure when a cover is closed in accordance with the first preferred embodiment of the present invention.
Figure 3:
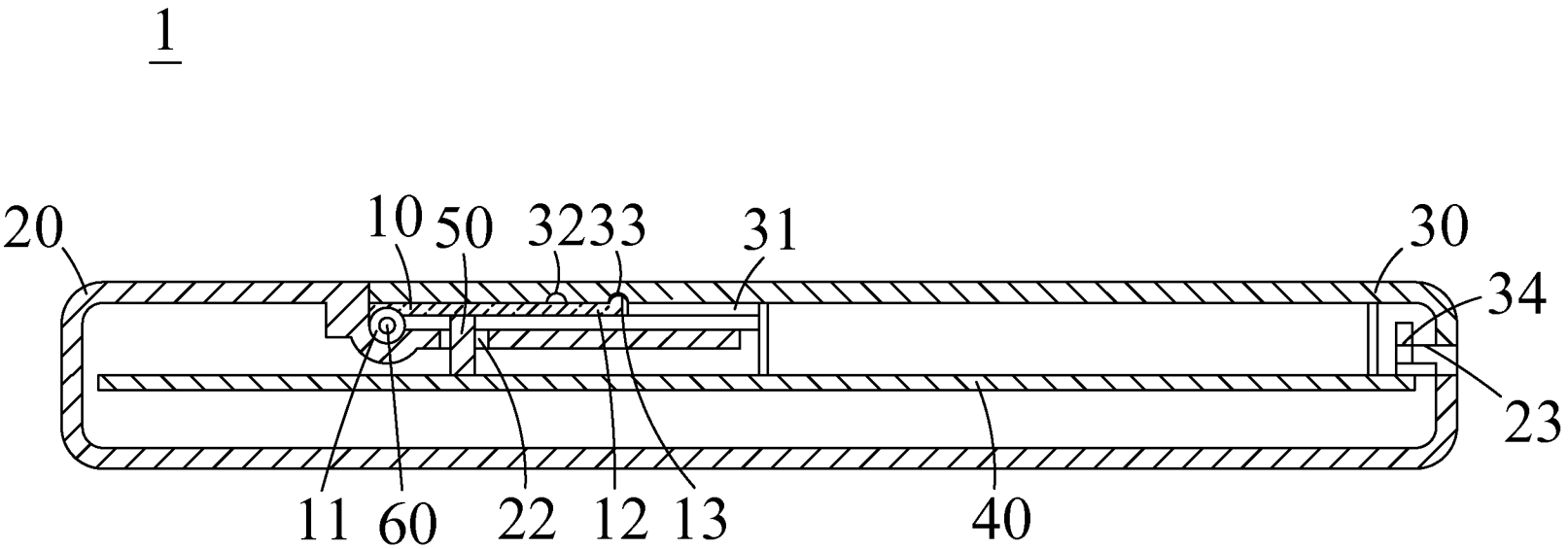
FIG. 3 is a cross-sectional view of a second operation of an antenna spring structure when a cover is closed in accordance with the first preferred embodiment of the present invention.

With reference to FIGS. 2 and 3 for cross-sectional views of the first and second operations of an antenna spring structure when a cover is closed in accordance with the first preferred embodiment of the present invention, respectively. When it is necessary to close the cover 30 of the wireless communication electronic device 1, an external force is applied to push and press the cover 30, and the pivot component 60 passing through the shaft hole 11 can be used as an axis for a rotation. Thus, the antenna spring 10 can be moved from the first position 14 to the second position 15, while the antenna spring 10 can be coupled to the circuit board 40 through the conductive component 50 and the antenna transmission module 41 (as shown in FIG. 1). Now, the external force pushes the cover 30 inwardly, and the antenna spring 10 can only be slid towards the interior when the cover 30 is pushed inwardly due to the limitation of the slide slot 31, and the elastic arm 12 of the antenna spring 10 is elastically deformed by the external force, and the protruding portion 13 originally wedged into the first positioning groove 32 of the cover 30 is now wedged into the second positioning groove 33. In the meantime, a latch portion 34 of the cover 30 is wedged into a wedged opening 23 of the casing 20 to assure the limitation of the freedom of the cover 30, so that the cover 30 can be closed tightly. The antenna spring 10 can pass through the opening 22 of the casing 20 through the conductive component 50 to assure a secured connection with the antenna transmission module 41 on the circuit board 40.

On the other hand, if it is necessary to open the cover 30, the cover can be pushed outward, such that the protruding portion 13 wedged into the second positioning groove 33 is now wedged into the first positioning groove 32. The latch portion 34 of the cover 30 is separated from the wedged opening 23 of the casing 20 to enable the cover 30 to be opened. Further, the antenna structure may have a torque spring or a spring plate (not shown in the figure), such that the resilience of the torque spring or the spring plate makes the antenna spring 10 spring from the second position 15 to the first position 14.

Figure 4:
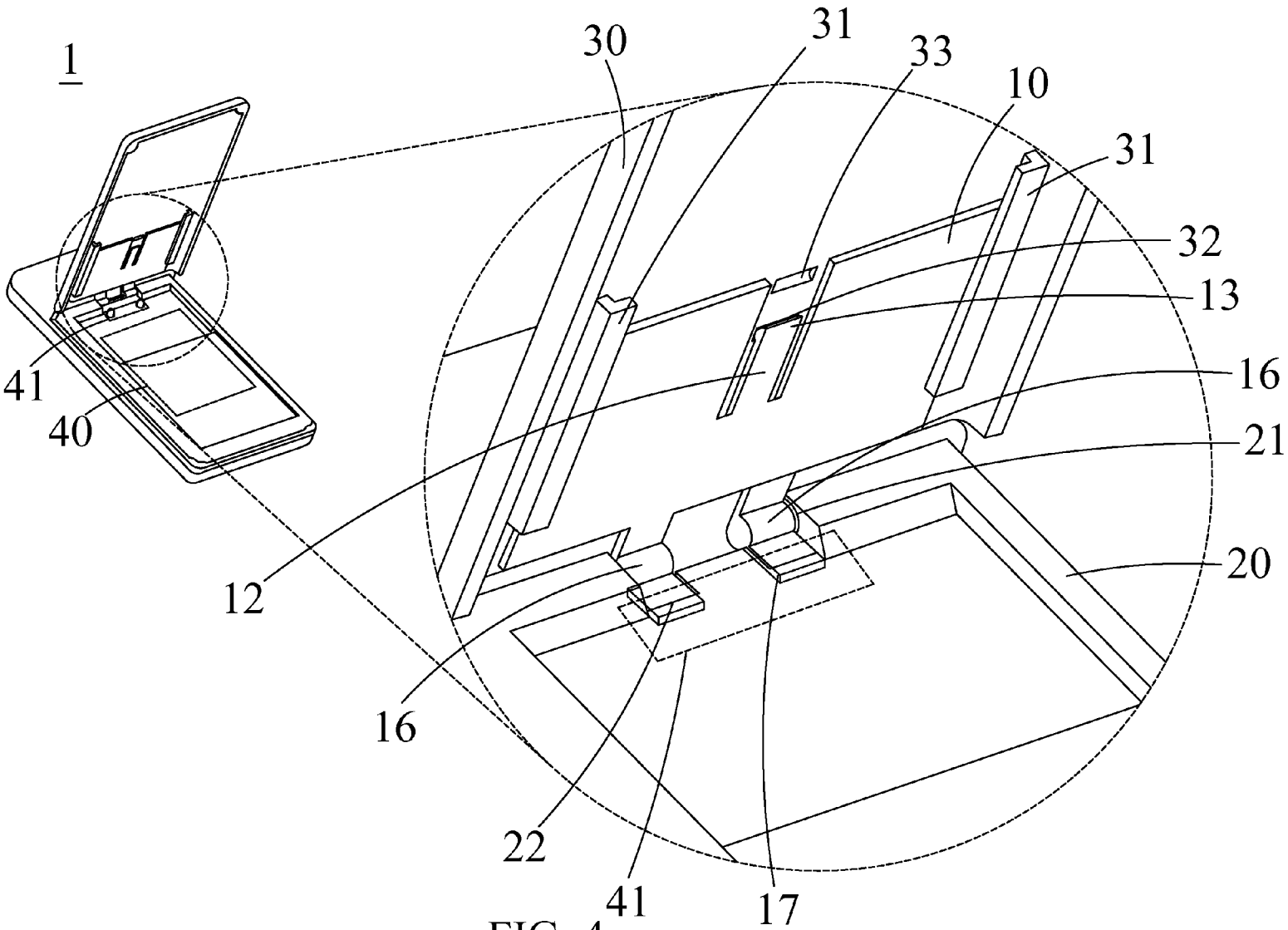
FIG. 4 is a perspective view of an antenna spring structure when a cover is opened in accordance with a second preferred embodiment of the present invention.

With reference to FIG. 4 for a perspective view of an antenna spring structure when a cover is opened in accordance with a second preferred embodiment of the present invention, the antenna spring structure is applied in a wireless communication electronic device 1 and comprises an antenna spring 10, a casing 20, a cover 30 and a circuit board 40. Wherein, the antenna spring 10 is substantially rectangular and made by bending a metal or alloy plate. The antenna spring 10 includes two pivoting portions 16 and two conductive portions 17 formed at the bottom of the antenna spring 10 and disposed with an interval apart from one another. An elastic arm 12 is formed by evacuating two areas having an appropriate interval apart at the middle of the antenna spring 10. The elastic arm 12 is coupled to a protruding portion 13 towards the top. The casing 20 includes two wedged holes 21, and the two pivoting portions 16 of the antenna spring 10 are wedged into the two wedged holes 21 of the casing 20.

The cover 30 includes two L-shaped slide slots 31 disposed on both sides of the antenna spring 10 respectively, and the cover 30 is provided with a first positioning groove 32 and a second positioning groove 33 formed on the protruding portion 13 and with an interval apart with each other. The protruding portion 13 can be wedged into the first positioning groove 32 or the second positioning groove 33, so that the cover 30 can selectively slide to one of the two positions of the antenna spring 10. The circuit board 40 is disposed inside the casing 20 and includes an antenna transmission module 41 corresponding to the conductive portion 17 for transmitting and receiving antenna signals. The conductive portion 17 passes through the two openings 22 of the casing 20 and extended deeply into the casing 20.

When the cover 30 is opened, the protruding portion 13 of the antenna spring 10 slides in the first positioning groove 32 of the cover 30. Since the cover 30 is installed on the antenna spring 10, and the antenna spring 10 is pivotally coupled to the casing 20, the probability of missing the cover 30 decreases.

Figure 5:
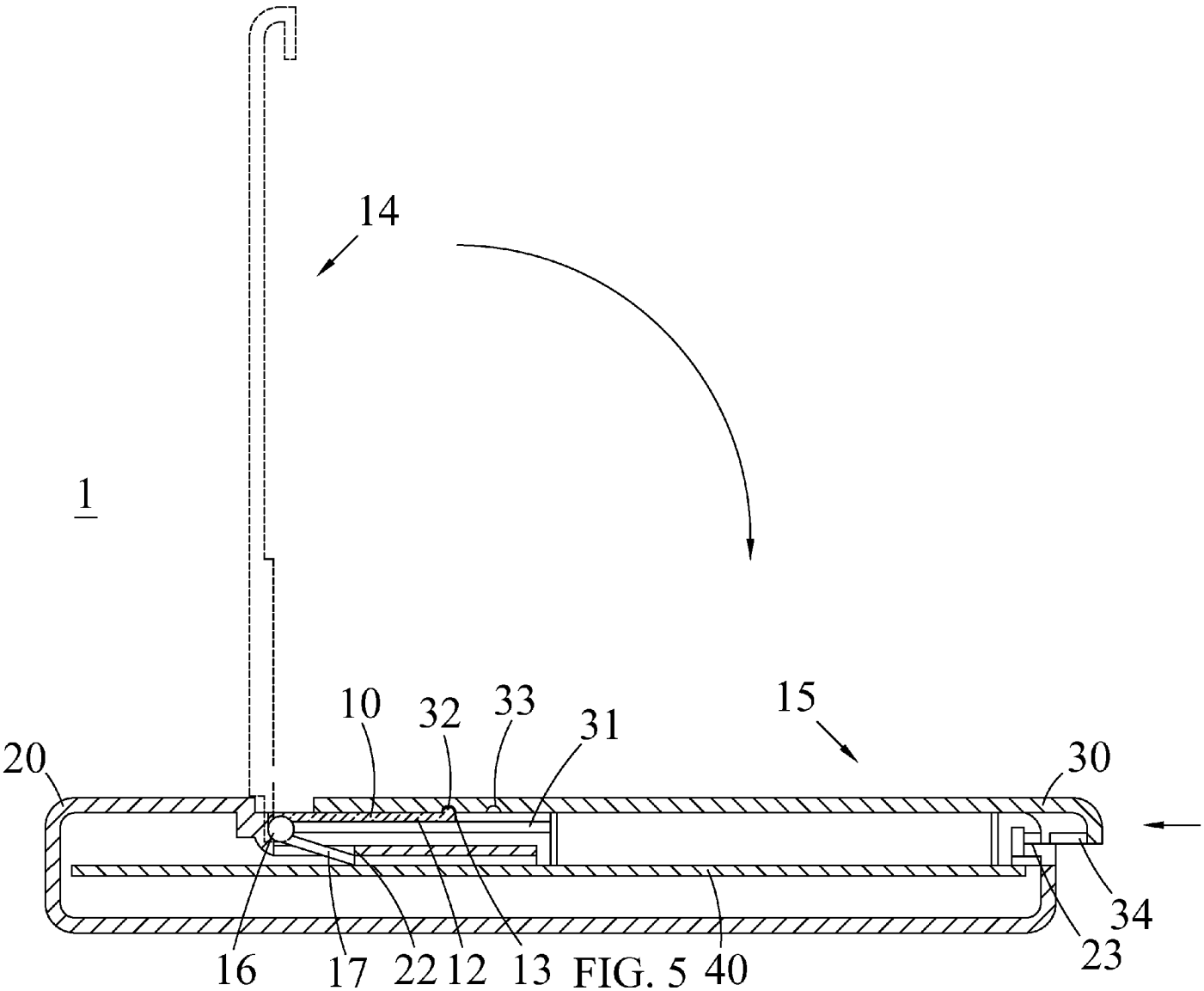
FIG. 5 is a cross-sectional view of a first operation of an antenna spring structure when a cover is closed in accordance with the second preferred embodiment of the present invention.
Figure 6:
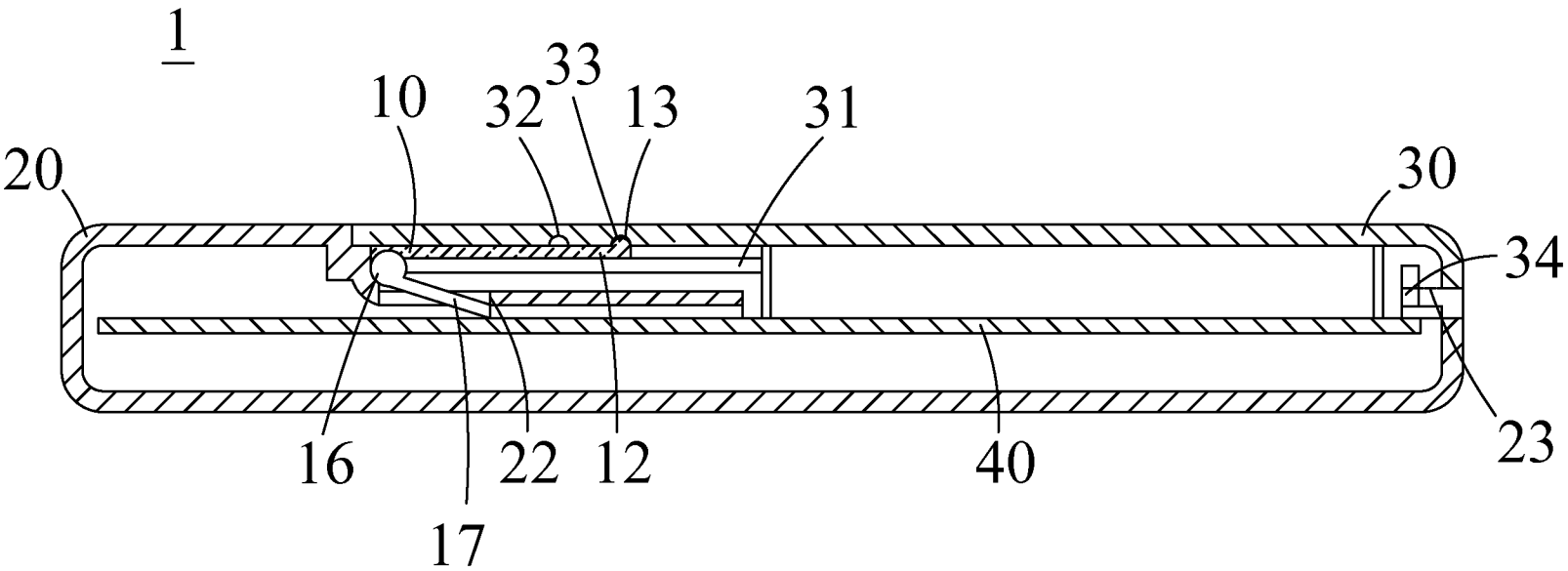
FIG. 6 is a cross-sectional view of a second operation of an antenna spring structure when a cover is closed in accordance with the second preferred embodiment of the present invention.

With reference to FIGS. 5 and 6 for cross-sectional views of the first and second operations of an antenna spring structure when a cover is closed in accordance with the second preferred embodiment of the present invention respectively. When it is necessary to close the cover 30 of the wireless communication electronic device 1, an external force is applied to push the cover 30 and rotate the cover 30 by using the pivoting portion 16 as an axis. Then the antenna spring 10 is moved from the first position 14 to the second position 15, while the antenna spring 10 is pressed and coupled to the circuit board 40 through the conductive portion 17 and the antenna transmission module 41 (as shown in FIG. 4). Now, the external force pushes the cover 30 inward. When the cover 30 is pushed inward, the antenna spring 10 can only slide inward due to the limitation of the slide slot 31, and the elastic arm 12 of the antenna spring 10 is deformed by the external force. The protruding portion 13 originally wedged into the first positioning groove 32 of the cover 30 is now wedged into the second positioning groove 33. While the latch portion 34 of the cover 30 is wedged into the wedged opening 23 of the casing to assure the limitation of the freedom of the cover 30 in order to close the cover 30 tightly. The conductive portion 17 of the antenna spring 10 is moved in the opening 22 of the casing 20 and presses against the antenna transmission module 41 of the circuit board 40 tightly to assure a secured connection.

On the other hand, if it is necessary to open the cover 30, the cover 30 is pushed outward, so that the protruding portion 13 wedged into the second positioning groove 33 is now wedged into the first positioning groove 32, and the latch portion 34 of the cover 30 is separated from the wedged opening 23 of the casing 20 to enable the cover 30 to be opened. Further, the conductive portion 17 of the antenna spring 10 may be designed with a default included angle (not shown in the figure) with respect to the antenna spring 10, so as to assure that the conductive portion 17 can be pressed tightly against the antenna transmission module 41 when the cover 30 is closed. If the cover 30 is opened, the antenna spring 10 can resume the first position 14 from the second position 15 by the resilience of the conductive portion 17.

In this preferred embodiment, the remaining components and their implementation other than those described above are the same as those of the first preferred embodiment, and thus will not be described again.

In summation, the antenna spring structure comprises the antenna structure and the switch structure to save the design space of the wireless communication electronic device, so as to miniaturize the wireless communication electronic device.

The antenna spring structure can be combined with the antenna structure and switch structure to produce an integral structure to save material cost, manufacturing and labor cost. In addition, the cover of the antenna spring can be installed to the antenna spring, and the antenna spring can be pivotally coupled to the casing, such that the cover can be linked to the casing when the cover is opened or closed, so as to prevent the cover from missing easily.

While the invention has been described by means of specific embodiments, numerous modifications and variations could be made thereto by those skilled in the art without departing from the scope and spirit of the invention set forth in the claims.

What is claimed is:

1. An antenna spring structure, applied in an electronic device, and comprising:

an antenna spring provided with an elastic arm having a protruding portion;

a casing having at least one opening and pivotally coupled to an end of the antenna spring;

a cover disposed on the antenna spring and provided with a first positioning groove and a second positioning groove by an interval corresponding to the protruding portion;

a circuit board disposed inside the casing; and at least one conductive component disposed on the circuit board and passing through the at least one opening to be exposed from the casing;

wherein when the antenna spring is situated at a first position, the protruding portion is wedged into the first positioning groove; when the antenna spring is situated at a second position, the at least one conductive component presses the antenna spring.

2. The antenna spring structure of claim 1, wherein the antenna spring further comprises at least one shaft hole, and the casing further comprises at least one wedged hole, and the antenna spring structure further comprises a pivot component passing through the at least one shaft hole and wedged into the at least one wedged hole.

3. The antenna spring structure of claim 1, wherein the cover includes at least one slide slot sheathed on the antenna spring.

4. The antenna spring structure of claim 1, wherein the cover includes at least one latch portion, and the casing includes at least one wedged opening corresponding to the at least one latch portion; when the antenna spring is situated at the second position and the protruding portion is wedged into the second positioning groove, the at least one latch portion is wedged into the at least one wedged opening.

5. The antenna spring structure of claim 1, wherein the circuit board further includes an antenna transmission module electrically coupled to the at least one conductive component.

6. The antenna spring structure of claim 1, wherein the antenna spring is formed by bending a metal plate or an alloy plate, and the at least one conductive component is made of a metal or an alloy.

7. An antenna spring structure, applied in an electronic device, and comprising:

an antenna spring provided with at least one pivoting portion, at least one conductive portion and an elastic arm, and the elastic arm being coupled to a protruding portion;

a casing provided with at least one opening and at least one wedged hole, the at least one opening being formed correspondingly to the conductive portion, and the at least one wedged hole and the at least one pivoting portion being pivotally coupled;

a cover disposed on the antenna spring and provided with a first positioning groove and a second positioning groove by an interval corresponding to the protruding portion; and a circuit board disposed inside the casing and provided with an antenna transmission module corresponding to the at least one conductive portion; wherein when the antenna spring is situated at a first position, the protruding portion is wedged into the first positioning groove; and when the antenna spring is situated at a second position, the conductive portion presses the antenna transmission module.

8. The antenna spring structure of claim 7, wherein the cover includes at least one slide slot sheathed on the antenna spring.

9. The antenna spring structure of claim 7, wherein the cover includes at least one latch portion, and the casing includes at least one wedged opening corresponding to the at least one latch portion; and when the antenna spring is situated at the second position and the protruding portion is wedged in the second positioning groove, the at least one latch portion is wedged in at least one embedded opening.

10. The antenna spring structure of claim 7, wherein the antenna transmission module is electrically coupled to the at least one conductive portion, and the antenna spring is formed by bending a metal plate or an alloy plate.

11. An electronic device, comprising:

a casing having at least one opening;

a circuit board disposed inside the casing; and an antenna spring structure, comprising:

an antenna spring provided with an elastic arm having a protruding portion, wherein the casing is pivotally coupled to an end of the antenna spring;

a cover disposed on the antenna spring and provided with a first positioning groove and a second positioning groove by an interval corresponding to the protruding portion; and at least one conductive component disposed on the circuit board and passing through the at least one opening to be exposed from the casing;

wherein when the antenna spring is situated at a first position, the protruding portion is wedged into the first positioning groove; when the antenna spring is situated at a second position, the at least one conductive component presses the antenna spring.

12. The electronic device of claim 11, wherein the antenna spring further comprises at least one shaft hole, and the casing further comprises at least one wedged hole, and the antenna spring structure further comprises a pivot component passing through the at least one shaft hole and wedged into the at least one wedged hole.

13. The electronic device of claim 11, wherein the cover includes at least one slide slot sheathed on the antenna spring.

14. The electronic device of claim 11, wherein the cover includes at least one latch portion, and the casing includes at least one wedged opening corresponding to the at least one latch portion; when the antenna spring is situated at the second position and the protruding portion is wedged into the second positioning groove, the at least one latch portion is wedged into the at least one wedged opening.

15. The electronic device of claim 11, wherein the circuit board further includes an antenna transmission module electrically coupled to the at least one conductive component.

16. The electronic device of claim 11, wherein the antenna spring is formed by bending a metal plate or an alloy plate, and the at least one conductive component is made of a metal or an alloy.

* * * * *